US006572670B1

(12) United States Patent
Theide et al.

(10) Patent No.: US 6,572,670 B1
(45) Date of Patent: Jun. 3, 2003

(54) COLORED METAL CLAY AND COLORED METALS

(75) Inventors: Billie Jean Theide, Champaign, IL (US); Rimas T. VisGirda, Champaign, IL (US)

(73) Assignee: Board of Trustees of University of Illinois, Urbana, IL (US)

( * ) Notice: Subject to any disclaimer, the term of this patent is extended or adjusted under 35 U.S.C. 154(b) by 19 days.

(21) Appl. No.: 09/712,037

(22) Filed: Nov. 14, 2000

(51) Int. Cl.[7] ..... C22C 5/00

(52) U.S. Cl. ..... 75/235; 75/246; 75/247; 75/252

(58) Field of Search ..... 148/430

(56) References Cited

U.S. PATENT DOCUMENTS

| | | | | |
|---|---|---|---|---|
| 3,622,310 A | * | 11/1971 | Reinacher et al. | 148/513 |
| 3,630,792 A | | 12/1971 | Smyth et al. | |
| 4,426,356 A | | 1/1984 | Nair | 419/21 |
| 4,476,090 A | * | 10/1984 | Heidsiek et al. | 419/19 |
| 5,202,013 A | | 4/1993 | Chamberlain et al. | |
| 5,328,775 A | * | 7/1994 | Hoshino et al. | 428/560 |
| 5,376,328 A | | 12/1994 | Hoshino et al. | |

FOREIGN PATENT DOCUMENTS

| | | |
|---|---|---|
| AU | 534 964 B | 2/1984 |
| DE | 20 52 749 A | 5/1972 |
| JP | 7196960 | 8/1995 |

OTHER PUBLICATIONS

PMC and PMC+ User's Guide, Second Edition, Text by Tim McCreight, Photos by Robert Diamante, copyright 2000, The Bell Group, Inc., 16 pages.

Silver Alchemy, article from the Internet entitled "A Brief History of Precious Metal Clay", Silver Alchemy Marketing Ltd., Aug. 31, 2000, <http://www.silveralchemy.com/history.html>, 1 page.

Precious Metal Clay (PMC) Jewelry Samples, article from the Internet entitled "Precious Metal Clay (PCM)", Aug. 31, 2000, <http://www.digitalid.com/jewelry/pmc.html>, 1 page.

News releases (Jul. 22, 1999), article from the Internet entitled Mitsubishi Materials Steps Up Sales of Precious Metal Clay in United States Company enlists U.S. sales agent, Aug. 31, 2000, <http://www.mmc.co.jp/english/corporate/news/news19990722.html>, 1 page.

Nonferrous refining, article from the Internet entitled "Nonferrous refining", Mitsubishi Materials, Aug. 31, 2000, <http://google.yahoo.com/bin/query?p=mitsubishi+AND+%22precious+metal+clay%22&hc=0&hs=0>, 2 pages.

Yahoo! Search Results for mitsubishi and "precious metal clay", Aug. 31, 2000, <http://www.mmc.co.jp/english/business/nonferrous.html>, 2 pages.

Mason Stains, article from the Internet entitled "Mason Stains", Sep. 11, 2000, <http://www.pottery–books.com/cgi–local/axner/loadpage.cgi?user_id=5917835&fil. . . /masonstains.html>, 5 pages.

Silver Alchemy—Firing PMC, article from the Internet entitled "Firing PMC", Silver Alchemy Marketing Ltd., Sep. 28, 2000, <http://www.silveralchemy.com/firing.html>, 1 page.

Silver Alchemy—Where To Buy PMC, article from the Internet entitled "Where To Buy PMC", Silver Alchemy Marketing Ltd., Sep. 28, 2000, <http://www.silveralchemy.com/wheretobuy.html>, 1 page.

Masons, article from the Internet entitled "Stain Analysis", Sep. 28, 2000, >http://www.walkerceramics.com au/masons. htm>, w pages PMC Studio — Why Not Bronze PMC?, article from the Interent entitled "Why Not Bronze PMC?", Sep. 28, 2000, <http:/www.pmclay.com/v31feature2.html>, 1 page.

Grit and Microgrit Grading Conversion Chart at READE, article from the Internet entitled "Grit and Microgrit Grading Conversion Chart", Oct. 2, 2000, <http://www.reade.com/Sieve/grit_conversion.html>, 3 pages.

Mesh to Micron Conversion Chart —FLUIDENG.COM, article from the Internet entitled "Mesh To Micron—Conversion Chart", Oct. 3, 2000, <http://www.fluideng.com/FE/meshmicron.html>, 1 page.

Catalog entitled "Gems & Findings Aug. 2000–Aug. 2001", 531 pages.

Catalog entitled Color Chart and Reference Guide—Mason Color, Mason Color Works, Inc., obtained Sep. 2000.

Copy of Search Report from Corresponding PCT Application No. PCT/US01/50370, dated Nov. 21, 2002 3 pages.

* cited by examiner

*Primary Examiner*—Roy King
*Assistant Examiner*—Andrew Wessman
(74) *Attorney, Agent, or Firm*—Brinks Hofer Gilson & Lione

(57) ABSTRACT

A composition for forming metal objects includes (a) first particles containing a jewelry-metal, and (b) second particles containing a refractory metal oxide. The composition allows the preparation of jewelry-metal in a large variety of colors.

22 Claims, No Drawings

COLORED METAL CLAY AND COLORED METALS

BACKGROUND

The present invention relates to metal clays with refractory stains.

Upon sintering, jewelry-metal clays form pure or almost pure jewelry-metal objects that retain the basic shape of the jewelry-metal clay. The clays contain a jewelry-metal powder and a binder; the binder is mostly removed during the sintering process. Jewelry-metal clays are described in U.S. Pat. Nos. 5,376,328 and 5,328,775. Jewelry-metal clay is referred to in the trade as precious metal clay, or PMC, and is available from RIO GRANDE, 7500 Bluewater Road N.W., Albuquerque, N.Mex., 87121, among others.

The ability to color jewelry-metal objects is limited. Jewelry-metal gold is an excellent example. Although white, rose, green, and varying shades of yellow gold are known, each is made by alloying pure gold with a second metal. The achievable color variation in any jewelry-metal, whether 24 karat gold, 18 karat gold, 14 karat gold, 10 karat gold, Nu-gold (88% wt. Cu 12% wt. Zn), fine silver, sterling silver (92.5% wt. Ag/7.5% wt. Cu), nickel silver (65% wt. Cu/18% wt. Ni/17% wt. Zn), platinum, palladium, ruthenium, rhodium, aluminum, brass, lead, nickel, iridium, indium, copper, zinc, or combinations thereof, is typically limited to the alloys these metals form. Accordingly, there is a need to expand the varieties of colors of jewelry-metal articles.

Refractory stains have many uses and are widely used to color ceramics. Prior to firing, the stain is incorporated into the slip and/or applied as a glaze. The stains are prepared by mixing together metal oxides and various inorganic and metal binders, which are fired for color stability, and then ground.

BRIEF SUMMARY

In a first aspect, the present invention includes a composition for forming metal objects, including first particles containing a jewelry-metal, and second particles including a refractory metal oxide; The composition may be made by mixing these ingredients together.

In a second aspect, the present invention includes a metal object, containing a jewelry-metal; and second particles containing a refractory metal oxide, in the jewelry-metal.

DETAILED DESCRIPTION

Jewelry-metal clays and refractory stains may be combined to form a colored metal clay. When sintered, the colored metal clay forms a colored jewelry-metal article, due to incorporation of the stain. Because jewelry-metal clays are sintered to remove their binder constituents at temperatures lower than those at which refractory stains degrade, jewelry-metals having the color of the stain are possible. The stain is present on the surface and in the subsurface of the finished jewelry-metal article, not simply as a surface coating. The actual color of the final product will be influenced by the natural color of the jewelry-metal and the color of the stain.

Jewelry-metal clays form almost pure jewelry-metal articles after. sintering, preferably at temperatures of from 1470° F. to 1830° F. Because refractory stains do not undergo significant chemical reaction and degradation during sintering at these, and higher temperatures, the stains may be incorporated into the jewelry-metal clays. In the case of jewelry-metals which cannot tolerate sintering in air without significant oxidation, sintering may be carried out under vacuum, under an inert atmosphere, such as argon or nitrogen, or under a reducing atmosphere, such as hydrogen or methane.

Although the coloring of jewelry-metal objects is preferably achieved by mixing a refractory stain into a jewelry-metal clay before sintering, clays are not required. A jewelry-metal may be colored with stain, for example, by mixing the powdered metal and stain together, and then sintering the mixture below the melting point of the metal. Furthermore, once formed by any method, colored jewelry-metal may be mechanically formed into the desired shape using hand-tools, machines, or dies. Colored jewelry-metal wires could be produced in this manner.

As described in U.S. Pat. Nos. 5,328,775 and 5,376,328, a pure or almost pure jewelry-metal object may be formed as the solid-phase sintered product of a jewelry-metal clay. To manufacture the jewelry-metal article, a moldable clay mixture, containing a jewelry-metal powder and a binder, is shaped into a molded object. The molded object is then sintered. An almost pure jewelry-metal article results which retains the shape of the clay, typically with some shrinkage. To prevent the metal from melting and loosing the shape into which the clay was molded, the clay is sintered at a lower temperature than the melting point of the jewelry-metal. Sintering is defined as heating sufficiently to cause the metal particles to stick together, but below the melting point of the metal.

Moldable clay mixtures are produced by blending jewelry-metal powders with a binder. Preferably, the binder is a cellulose binder prepared by blending a cellulose with water. Addition of a surface-active agent during mixing of the jewelry-metal powder and binder allows for more uniform mixing in a short time period. Addition of an adhesion-preventing agent, such as di-n-butyl phthalate or an oil such as a vegetable oil, prevents the clay from sticking to the skin of the hand during molding.

A preferable moldable clay mixture contains 50 to 90% by weight of jewelry-metal powder with an average particle diameter of at most 1000 $\mu$m, preferably at most 600 $\mu$m, most preferably at most 200 $\mu$m; 0.8 to 8% by weight of binder, more preferably a water-soluble cellulose binder; 0.08 to 3% by weight of a surface-active agent; and 0.1 to 4% by weight of oil; with the balance water and unavoidable impurities. Sintering of this jewelry-metal clay results in a solid-phase sintered product of a jewelry-metal.

Currently, three jewelry-metal clays are available from RIO GRANDE. An 80% pure silver clay (STANDARD SILVER PMC) is available with a recommended sintering time of two hours at 1650° F. A 90% pure silver clay (SILVER PMC+) is available with a recommended sintering time of thirty minutes at 1470° F. This clay provides the benefits of less shrinkage, lower sintering temp, and less sintering time. A 24 karat yellow gold clay (STANDARD GOLD PMC) is also available with a recommended sintering time of two hours at 1830° F. Other jewelry-metal clays may be prepared by mixing powder of one or more metals or alloys with a binder, optionally a solvent which will evaporate or burn away (water, ethanol, isopropanol, methanol, acetone, etc.), optionally a surface-active agent, and optionally an adhesion-preventing agent (di-n-butyl phthalate, vegetable oil, etc.).

Jewelry-metal clays may also be formed by more conventional methods involving the combination of jewelry-metal powders and binders such as bentonite, clay, glue, and boiled rice or wheat flower, and optionally water, as described in Japanese Patent Applications laid open with Publication Numbers 59-143001 and 63-403. Unlike cellulose-binder clays, these binders may remain in the jewelry-metal article after drying or sintering.

Refractory stains have been used to color ceramic articles for over 100 years and are available in numerous colors. In addition to shades of pink, blue, black, white, crimson, coral, purple, orange, gray, green, brown, yellow, and red, many color shades are available; Refractory stains may be obtained as MASON STAINS, available from MASON COLOR WORKS, INC., East Second Street P.O. Box 76, East Liverpool, Ohio, 43920, or as WALKER STAINS, available from WALKER CERAMICS, 55 Lusher Road., Croydon, Australia, 3136.

Refractory stains are metal oxides which are fired for color stability to form refractory metal oxides and ground into a fine powder with an average particle diameter of at most 50 mesh (for example 254 to 297 microns), preferably at most 100 mesh (for example 122 to 149 microns), and most preferably at most 200 mesh (for example 50 to 74 microns). One or more oxides of metals such as aluminum ($Al_2O_3$), antimony ($Sb_2O_3$), boron ($B_2O_3$), calcium (CaO), chromium ($Cr_2O_3$), cobalt (CoO), iron ($Fe_2O_3$), manganese ($MnO_2$), nickel (NiO), praseodymium ($Pr_6O_{11}$), selenium ($SeO_2$), silicon ($SiO_2$), tin ($SnO_2$), titanium ($TiO_2$), vanadium ($V_2O_5$), zinc (ZnO), and zirconium ($ZrO_2$) are combined in various proportions and then fired, to attain the desired color. In addition to metal oxides, refractory stains optionally contain various metal and inorganic binders. Any combination may be used, as long as the metal oxide stain can withstand firing at a temperature high enough to allow sintering of the metal clay.

The stains may be any color, including black, white, or transparent. To achieve greater color variation, mixtures of stains are possible, Some examples of the available stain colors and the metal oxide components combined to form them are provided in the following MASON COLOR charts.

MASON COLOR COMPOSITION CHARTS

| New No. | Greens | Al | Ca | Co | Cr | Fe | Ni | Pr | Si | Sn | Ti | V | Zn | Zr | See Ref. |
|---|---|---|---|---|---|---|---|---|---|---|---|---|---|---|---|
| 6200 | Evergreen | | | X | X | | | | X | | | | | | 3, 5 |
| 6201 | Celadon | X | | X | X | | | | X | | | | X | | 1, 3, 6, 8 |
| 6202 | Florentine | | | X | X | | | | X | | | | | | 1, 3, 6, 8 |
| 6204 | Victoria Green | | X | | X | | | | X | | | | | X | 3, 5, 9 |
| 6206 | Grass Green | | X | | X | | | | X | | | | | X | 3, 5, 9 |
| 6207 | Celeste | | | X | X | | | | X | | | | X | | 1, 3, 6 |
| 6209 | Chrome Green | | | | X | | | | X | | | | | | 3, 5 |
| 6211 | Pea Green | | | | | | | | X | | X | X | | X | 1, 3, 6, 8 |
| 6219 | French | | X | X | X | | | | X | | | | X | | 1, 3, 5, 8 |
| 6221 | Turquoise | | X | X | X | | | | X | | | | X | X | 3, 5 |
| 6223 | Ivy | X | | | X | | | | X | | | | | | 3, 5 |
| 6224 | Dk. Green | | | X | X | X | | | X | | | | X | | 3, 5 |
| 6226 | Dk. Leaf | | | X | X | X | | | X | | | | X | | 1, 3, 6, 8 |
| 6234 | Myrtle Green | X | | X | X | | | | | | | | | | 1, 3, 6, 8 |
| 6236 | Chartreuse | | | | | | | | X | | X | X | | X | 1, 3, 6 |
| 6242 | Bermuda | | | | | | | X | X | | | X | | X | 3, 6 |
| 6244 | Deep Sea | X | | X | X | | | | X | | | | X | | 1, 3, 6, 8 |
| 6246 | Blue Green | | | X | X | | | | X | X | | | X | | 3, 6, 8 |
| 6254 | Dk. Teal Green | X | | X | X | | | | X | | | | X | | 1, 3, 6, 8 |
| 6255 | Jade Green | X | | X | X | | | | X | | | | X | | 1, 3, 6, 8 |
| 6263 | Victoria | | X | | X | | | | X | | | | | X | 3, 5, 9 |
| 6264 | Victoria | | X | | X | | | | X | | | | | X | 3, 5, 9 |
| 6265 | Leaf Green | | X | X | X | | | | X | | | | X | X | 3, 5, 9 |
| 6266 | Peacock | | | X | X | | | | | | | | | | 1, 3, 6, 8 |
| 6267 | Emerald | | X | X | X | | | | X | | | | | X | 3, 5, 9 |
| 6268 | Sea Green | | | X | X | | | | X | | | | X | | 1, 3, 6, 8 |
| 6271 | Mint | | X | X | X | | | | X | | | | X | X | 3, 5, 9 |
| 6274 | Nickel Silicate | | | | | | X | | X | | | | | | 1, 3 |
| 6280 | Avocado | X | | X | X | X | | | X | | X | X | X | X | 3, 6 |
| 6288 | Turquoise | | X | | X | | | | X | | | X | | X | 3, 5, 9 |
| 6296 | Dk. Spruce | | X | X | X | | | | X | | | | | | 1, 3, 6, 8 |

| New No. | Blacks | Co | Cr | Fe | Mn | Ni | Sn | Zn | See Ref. |
|---|---|---|---|---|---|---|---|---|---|
| 6600 | Best Black | X | X | X | | X | | | 1, 3, 6 |
| 6601 | Velvet Black | X | X | X | | X | | X | 1, 3, 6 |
| 6609 | Black | X | X | X | X | X | X | | 1, 3, 6 |
| 6612 | Onyx Black | X | X | X | | X | | | 1, 3, 6 |
| 6616 | Chrome-Free | X | | X | X | | | | 1, 3, 6 |
| 6650 | Cobalt-Free | | X | X | | | | | 3, 5 |
| 6657 | Black | X | X | X | | | | | 3, 5 |
| 6666 | Cobalt-Free | | X | X | X | | | | 3, 5 |

-continued

MASON COLOR COMPOSITION CHARTS

| New No. | Blues | Al | Co | Cr | Fe | Ni | Si | Sn | V | Zn | Zr | See Ref. |
|---|---|---|---|---|---|---|---|---|---|---|---|---|
| 6300 | Mazerine | | X | | | | X | | | X | | 1, 3, 6 |
| 6302 | Cadet | X | X | X | | | X | X | | X | | 1, 3, 6 |
| 6305 | Teal | X | X | X | | | X | | | X | | 1, 3, 6 |
| 6306 | Vivid Blue | X | X | | | | X | | | X | | 1, 3, 6 |
| 6307 | Pastel Blue | X | X | | | | | X | | | X | 1, 3, 6 |
| 6308 | Delphinium | X | X | | | | | X | | | | 1, 3, 6 |
| 6310 | Wedgwood | X | X | | | | X | | | | | 1, 3, 6 |
| 6313 | Medium Blue | | X | | | | X | | | X | | 1, 3, 6 |
| 6315 | Zirconium Vanadium | | | | | | X | | X | | X | 1, 3, 6 |
| 6320 | Delft | X | X | | | | X | X | | X | | 1, 3, 6 |
| 6330 | Cobalt Aluminate | X | X | | | | | | | | | 1, 3, 6 |
| 6336 | Peacock | X | X | X | | | X | X | | X | | 3, 6 |
| 6338 | Cobalt Meta-Silicate | | X | | | | X | | | | | 1, 3, 6 |
| 6339 | Royal | X | X | | | | | | | X | | 1, 3, 6 |
| 6343 | Mediterranean | X | X | X | | | X | | | X | | 1, 3, 6 |
| 6350 | Bright Blue | X | X | | | | X | | X | X | X | 1, 3, 6 |
| 6360 | Willow | X | X | X | | | X | X | | | | 3, 5 |
| 6363 | Sky Blue | X | X | | | | X | | | | | 1, 3, 6 |
| 6364 | Turquoise | | | | | | X | | X | | X | 1, 3, 6 |
| 6368 | Copen Blue | X | X | | | | X | | | X | | 1, 3, 6 |
| 6371 | Dark Teal | X | X | X | | | | | | | | 1, 3, 6 |
| 6373 | Turquoise | | X | X | | | | X | X | | X | 3, 6 |
| 6374 | Dk. Turquoise | | | | | | X | | X | | X | 1, 3, 6 |
| 6376 | Robin's Egg | | | | | | X | | X | | X | 1, 3, 6 |
| 6378 | Zirconium Vanadium | | | | | | X | | X | | X | 1, 3, 6 |
| 6383 | Cobalt Aluminate | X | X | | | | | | | | | 1, 3, 6 |
| 6386 | Navy Blue | | X | X | X | X | X | | | X | | 1, 3, 6 |
| 6388 | Mazerine | | X | | | | X | | | | | 1, 3, 6 |
| 6389 | Sapphire Blue | X | X | | | | | | | | | 1, 3, 6 |
| 6391 | Zirconium Vanadium | | | | | | X | | X | | X | 1, 3, 6 |
| 6393 | Turquoise | X | X | | | | X | X | X | | X | 3, 6 |
| 6396 | Peacock | X | X | X | | | X | | X | | X | 1, 3, 6 |
| 6398 | Deep Peacock | X | X | X | | | | | | | | 1, 3, 6 |

| New No. | Whites | Al | B | Ca | Si | Sn | Zr | See Ref. |
|---|---|---|---|---|---|---|---|---|
| 6700 | White | X | | | X | | X | 3, 6 |
| 6768 | Tin White | X | | | X | X | | 3, 6 |
| 6790 | White for Matting | | | | X | | X | 3, 6 |

| New No. | Pinks, Crimsons, & Corals | Al | Ca | Cr | Fe | Mn | Si | Sn | V | Zn | Zr | See Ref. |
|---|---|---|---|---|---|---|---|---|---|---|---|---|
| 6000 | Shell Pink | | | X | | | | X | | | | 3, 5, 9 |
| 6001 | Alpine Rose | | | X | | | | X | | | | 3, 5, 9 |
| 6002 | Rose Pink | | | X | | | | X | | | | 3, 5, 9 |
| 6003 | Crimson | | | X | | | | X | | | | 3, 5, 9 |
| 6004 | Crimson | | | X | | | | X | | | | 3, 5, 9 |
| 6005 | Deep Crimson | | | X | | | | X | | | | 3, 5, 9 |
| 6006 | Deep Crimson | | | X | | | | X | | | | 3, 5, 9 |
| 6007 | Peach | | | X | | | | X | X | | | 3, 5, 9 |
| 6008 | Peach | | | X | | | | X | X | | | 3, 5, 9 |
| 6009 | Coral | | | X | | | | X | X | | | 3, 5, 9 |
| 6020 | Manganese Alumina | X | | | | X | | | | | | 1, 3 |
| 6023 | Clover Pink | | | X | | | | X | X | | X | 3, 5 |
| 6029 | Persimmon | X | | X | X | | | | | X | | 3, 8 |
| 6031 | Deep Salmon | | | X | X | | | X | | | | 3, 5 |
| 6032 | Coral | | | | X | | X | | | | X | 3 |
| 6052 | Doll Flesh | X | | X | X | X | | | | X | | 1, 3, 6 |
| 6065 | Chrome Alumina | X | | X | | | | | | | | 1, 3, 6 |
| 6067 | Pink Extender | | X | | | | X | X | | | | 3, 5 |
| 6069 | Dark Coral | | | | X | | X | | | | X | 3 |
| 6090 | Coral | | | X | | | | X | X | | | 3, 5, 9 |
| 6098 | Flesh | | | X | | | | X | X | | X | 3, 5, 9 |

-continued

MASON COLOR COMPOSITION CHARTS

| New No. | Yellows | Al | Cr | Fe | Pr | Sb | Si | Sn | Ti | V | Zn | Zr | See Ref. |
|---|---|---|---|---|---|---|---|---|---|---|---|---|---|
| 6404 | Vanadium | X | | | | | | X | | X | | | 1, 3, 6 |
| 6405 | Naples | | | X | X | | X | | | | | X | 3, 6 |
| 6406 | Buttercup | | | X | X | | X | | | | | X | 3, 6 |
| 6407 | Marigold | | | X | X | | X | | | | | X | 3, 6 |
| 6408 | Praseodymium | | | | X | | X | | | | | X | 3, 6 |
| 6433 | Praseodymium | | | | X | | X | | | | | X | 3, 6 |
| 6440 | Vanadium | | | | | | | X | | X | | | 1, 3, 6 |
| 6450 | Praseodymium | | | | X | | X | | | | | X | 3, 6 |
| 6464 | Zirconium | | | | | | | | X | X | | X | 1, 3, 6 |
| 6471 | Old Gold | X | X | X | | | | X | | X | X | | 1, 3, 6 |
| 6485 | Titanium | | X | | | X | | | X | | | | 1a, 3 |

| New No. | Purples & Lavenders | Al | Ca | Co | Cr | Fe | Mn | Ni | Si | Sn | V | Zn | Zr | See Ref. |
|---|---|---|---|---|---|---|---|---|---|---|---|---|---|---|
| 6303 | Deep Orchid | X | | X | X | | | | | X | | | | 3, 5, 9 |
| 6317 | Lavender | X | | X | X | | | | | X | | X | | 3, 5, 9 |
| 6318 | Amaethyst | X | | X | X | | | | | X | | X | | 3, 5, 9 |
| 6319 | Lavender | X | | X | | | X | | X | | | X | | 1, 3 |
| 6324 | Violet | X | | X | X | | | | X | X | | X | X | 3, 5, 9 |
| 6331 | Orchid | X | | X | X | | | | | X | | X | | 3, 5, 9 |
| 6332 | Orchid | X | | X | X | | | | | X | | X | | 3, 5, 9 |
| 6333 | Lavender | X | | X | X | | | | | X | | X | | 3, 5, 9 |
| 6381 | Blackberry Wine | | | X | X | X | | X | X | X | | | | 3, 5, 9 |
| 6385 | Pansy Purple | | | X | X | | | | X | X | | | | 3, 5, 9 |
| 6387 | Mulberry | X | | X | X | | | | | X | | | | 3, 5, 9 |
| 6392 | Dusty Lavender | | | | X | | | | X | X | X | | X | 3, 5, 9 |

| New No. | Browns & Oranges | Al | Ca | Co | Cr | Fe | Mn | Si | Sn | Ti | V | Zn | Zr | See Ref. |
|---|---|---|---|---|---|---|---|---|---|---|---|---|---|---|
| 6100 | Woodland | X | | | X | X | | X | | | | X | | 3, 6, 7 |
| 6101 | Chestnut | | | | X | X | X | | | | | X | | 3, 6, 7 |
| 6103 | Golden | X | | | X | X | | | | | | X | | 3, 6, 7 |
| 6104 | Fawn | | | | X | | | | X | | X | | X | 3, 6, 7 |
| 6107 | Dk. Golden | X | | | X | X | | | | | | X | | 3, 6, 7 |
| 6108 | Walnut | | | | X | X | X | | | | | X | | 3, 6, 7 |
| 6109 | Deep Brown | X | | | X | X | | | | | | X | | 3, 6, 7 |
| 6110 | Violet Of Iron | X | | | | X | | X | | | | | | 3, 6, 7 |
| 6111 | Spice Brown | | | | | X | | | X | | | X | | 3, 6, 7 |
| 6113 | Claret | | | | X | X | | | | | | X | | 3, 6, 7 |
| 6119 | Russet | | X | | X | X | | | | | | X | X | 3, 6, 7 |
| 6121 | Saturn Orange | X | | | X | X | | | | | | | | 3, 6, 7 |
| 6122 | Cedar | X | | | X | X | | | | | | X | | 3, 6, 7 |
| 6123 | Saddle | X | | | X | X | | | | | | X | | 3, 6, 7 |
| 6124 | Chocolate | X | | | X | X | X | | | | | X | | 3, 6, 7 |
| 6125 | Leather | X | | | X | X | | | | | | X | | 3, 6, 7 |
| 6126 | Hazelnut | X | | | X | X | | | | | | X | | 3, 7 |
| 6129 | Golden Ambrosia | X | | | X | X | | | | | | X | | 3, 6, 7 |
| 6131 | Titanium Iron | | | | | X | | | | X | | | | 1a, 3, 6 |
| 3132 | Red Brown | | | | X | X | | | | | | X | | 3, 6, 7 |
| 3133 | Sorrel Brown | | | | X | X | | | | | | X | | 3, 6, 7 |
| 6134 | Red Brown | | | | X | X | | | | | | X | | 3, 6, 7 |
| 6149 | Iron Silicate | | | | | X | | X | | | | | | 3, 6, 7 |
| 6155 | Black Brown | | | | X | X | | | | | | | | 3, 6, 7 |
| 6153 | Seal Brown | | | | X | X | X | | | | | X | | 3, 6, 7 |
| 6160 | Dk. Chocolate | X | | | X | X | X | | | | | X | | 3, 6, 7 |
| 6163 | Terra Cotta | X | | | X | X | | | | | | X | | 3, 6, 7 |
| 6166 | Camel Beige | X | | X | X | X | X | | | | | X | | 3, 6, 7 |
| 6190 | Deep Brown | | | | X | X | X | | | | | | | 3, 6, 7 |
| 6194 | Manganese Silicate | | | | | | X | X | | | | | | 3, 6, 7 |

-continued

MASON COLOR COMPOSITION CHARTS

| New No. | Greys | Al | Co | Cr | Fe | Mn | Ni | Sb | Si | Sn | Ti | V | Zr | See Ref. |
|---|---|---|---|---|---|---|---|---|---|---|---|---|---|---|
| 6500 | Sage | | X | X | | | X | | X | | | | | 1, 3, 6 |
| 6503 | Taupe | X | | X | X | | | | X | | | | X | 3, 5, 9 |
| 6506 | Pearl | | X | X | X | | X | | | X | | | | 3, 6 |
| 6515 | Soft Medium | X | | X | X | X | | | X | | | | X | 3, 5 |
| 6523 | Soft Green | X | X | X | X | X | X | | X | X | | | X | 3, 5 |
| 6527 | Shadow | X | | X | X | | | | X | X | | | X | 3, 5, 9 |
| 6528 | Charcoal | | X | X | X | | X | | | X | | | | 3, 6 |
| 6530 | Silver | | X | X | X | | X | | | X | | | | 3, 6 |
| 6531 | Slate | | X | X | X | | X | | | X | | | | 1, 3, 6 |
| 6537 | Mouse | X | | X | X | | | | X | X | | | X | 3, 5, 9 |
| 6540 | Blue-Grey | | X | X | X | | X | | | X | | | | 3, 6 |
| 6572 | Neutral | | | X | X | | | | | | | | X | 3, 5 |
| 6573 | Rose Taupe | | | X | X | | | | | X | X | X | X | 3, 5, 9 |
| 6584 | Tin Grey | | | | | | | X | | X | | | | 2, 8 |
| 6591 | Gun Metal | | X | | | | X | | | | | | X | 3, 6 |

Reference Notes For Color Composition Charts

1. Can be used as a 'body stain' in porcelain at high temperatures. All of the brown colors can be used as 'body stains' but will vary in shade considerably depending on the composition of the body and temperature at which it is fired.

1a. Use only as 'Body Stain'

Firing Temperatures can only be a rough guide. Firing at 2200° F. on a slow schedule may give the equivalent maturing as firing at 2300° F. on a fast schedule. The cycle, atmosphere, and rate of cooling will affect the color.

2. Max. firing limit 2156° F. (1180° C.).

3. Max. firing limit 2300° F. (1260° C.).

4. Max. firing limit 1976° F. (1080° C.).

Zinc Oxide influences the color in a glaze more than any other element. Generally, zincless glazes should not contain magnesium oxide. Some colors containing zinc are to be used in a zincless glaze. The zinc in the color is in a combined form and will not harm the color, but free zinc oxide in the glaze can destroy the color.

5. Do not use zinc in glaze.

6. May be used with zinc or without zinc.

7. Zinc not necessary, but gives better results.

8. Best results with no zinc.

Calcium Oxide content as calcium carbonate should be from 12–15% for best color development. Adding the molecular equivalent of calcium oxide with wollastonite, a natural calcium silicate, often gives better uniformity. The increased silica from the wollastonite must be subtracted or the glaze will have a poor surface.

9. Glaze must contain from 6.7 to 8.4% CaO (12–15% $CaCO_3$)

Metal to Metal Oxide Conversion Key for Color Composition Charts

| | | |
|---|---|---|
| Al | Aluminum Oxide | $Al_2O_3$ |
| B | Boric Oxide | $B_2O_3$ |
| Ca | Calcium Oxide | CaO |
| Co | Cobalt Oxide | CoO |
| Cr | Chromium Oxide | $Cr_2O_3$ |
| Fe | Iron Oxide | $Fe_2O_3$ |
| Mn | Manganese Dioxide | $MnO_2$ |
| Ni | Nickel Oxide | NiO |
| Pr | Praseodymium Oxide | $Pr_6O_{11}$ |
| Sb | Antimony Oxide | $Sb_2O_3$ |
| Si | Silicon Dioxide | $SiO_2$ |

-continued

Metal to Metal Oxide Conversion Key for Color Composition Charts

| | | |
|---|---|---|
| Sn | Tin Dioxide | $SnO_2$ |
| Ti | Titanium Dioxide | $TiO_2$ |
| V | Vanadium Pentoxide | $V_2O_5$ |
| Zn | Zinc Oxide | ZnO |
| Zr | Zirconium Dioxide | $ZrO_2$ |

Refractory metal oxides are metal oxides stable in air at a temperature of at least 1600° F., preferably at least 1800° F., more preferably at least 1976° F., most preferably at least 2700° F. Here, the term "refractory" means stable in air at temperatures of at least 1600° F., and "stable" means without significant color degradation after heating in air to the specified temperature and cooling to room temperature.

Mesh is a way to define the diameter of a particle by the size of interstitial site in a wire mesh through which the particle will pass. For example, 200 mesh particles will pass through the interstices of a wire screen with 200 wires per inch. Since the particle size that will pass through a screen decreases with increasing mesh number, particles defined as 200 mesh will contain all those capable of passing through a 200 wire per inch screen and smaller. Two-hundred mesh particles contain 400 mesh, but not 100 mesh.

Since mesh is not a direct measurement of individual particles, but a characteristic of those that can pass through a specific screen, it is best thought of as representing the average particle diameter of all the particles that pass through the screen, averaged. Fifty mesh particles preferably have an average particle diameter of from 254 to 297 microns. One-hundred mesh particles preferably have an average particle diameter of 22 to 149 microns. Two-hundred mesh particles preferably have an average particle diameter of 40 to 85 microns, more preferably 45 to 80 microns, and most preferably 50 to 74 microns. Four-hundred mesh particles have an average particle diameter of 5 to 47 microns, preferably 10 to 42 microns, and most preferably 15 to 37 microns.

EXAMPLES

Example 1

Five grams of silver jewelry-metal clay was weighed and handled in accordance to information provided by MITSUB- ISHI MATERIALS CORPORATION. After shaping three separate five gram clay samples into pancake-like forms, 0.1 gram of refractory stain was added to the first, 0.3 gram to the second, and 0.5 gram to the third. Each sample was kneaded until the refractory stain was thoroughly distributed throughout the jewelry-metal clay. A droplet of water was added to ease kneading of the 0.3 and 0.5 gram stain addition samples.

The jewelry-metal clay samples containing the refractory stain were each rolled into an oval sheet and weighed. The samples were allowed to thoroughly dry before firing, and their dry weights recorded.

The samples were fired on an earthenware tile, dusted with clean alumina hydrate. The tile was stilted and placed in an electronically monitored electric kiln. The samples were fast-fired according to MITSUBISHI MATERIALS CORPORATION's specifications (1650° F. for two hours). The kiln was allowed to cool before the samples were removed. The fired samples were weighed and the weights recorded.

The samples were successfully colored with the color of the chosen refractory stain. The color was perfectly distributed. The sample containing the highest concentration (0.5 gram or 10% by weight) of refractory stain provided a darker colored silver article. The sample containing the lowest concentration (0.1 gram or 2% by weight) of refractory stain provided a lightly colored silver article. The resultant articles were malleable, like uncolored jewelry-metal clay sintered articles. The resultant articles demonstrated shrinkage, like uncolored jewelry-metal clay sintered articles, but showed no additional deformation or loss of detail in comparison to uncolored articles.

Prophetic Example 1

Five grams of gold jewelry-metal clay is weighed and handled in accordance to information provided by MITSUBISHI MATERIALS CORPORATION. After shaping three separate five gram clay samples into pancake-like forms, 0.1 gram of refractory stain is added to the first, 0.3 gram to the second, and 0.5 gram to the third. Each sample is kneaded until the refractory stain is thoroughly distributed throughout the jewelry-metal clay. A droplet of water is added to ease kneading of the 0.3 and 0.5 gram stain addition samples.

The jewelry-metal clay samples containing the.refractory stain are each rolled into an oval sheet and weighed. The samples are allowed to thoroughly dry before firing, and their dry weights recorded.

The samples are fired on an earthenware tile, dusted with clean. alumina hydrate. The tile is stilted and placed in an electronically monitored electric kiln, The samples are fast-fired according to MITSUBISHI MATERIALS Corporation's specifications (1830° F. for two hours). The kiln is allowed to cool before the samples are removed. The fired samples are weighed and the weights recorded.

Prophetic Example 2

A five gram sample of finely ground silver is weighed. One-half gram of refractory stain is added and thoroughly mixed with the silver powder. The powdered mixture of silver and refractory stain is pressed into a cylinder and fired in an electronically monitored electric kiln at 1470° F. for thirty minutes. The kiln is allowed to cool before the sample is removed. The colored silver mass is then removed and could be shaped into the desired item with hand tools, machine, or die. The colored silver could also be hammered or drawn into wires.

Obviously, numerous modifications and variations of the present invention are possible in light of the above teachings. It is therefore to be understood that within the scope of the appended claims, the invention may be practiced otherwise than as specifically described herein.

What is claimed is:

1. A composition for forming metal objects, comprising:

(a) first particles comprising a jewelry-metal, and (b) second particles comprising a refractory stain, wherein the refractory stain comprises metal oxides that are fired for color stability and ground into a fine powder having an average particle diameter of at most 50 mesh prior to incorporation into said composition.

2. The composition of claim 1, wherein said jewelry-metal is selected from the group consisting of silver, gold, and platinum.

3. The composition of claim 2, wherein said first particles consist essentially of a member selected from the group consisting of fine silver, sterling silver, 24 karat gold, 18 karat gold, 14 karat gold, and 10 karat gold.

4. The composition of claim 2, further comprising (c) a binder.

5. The composition of claim 2, further comprising (d) a solvent.

6. The composition of claim 2, further comprising (e) a surface-active agent.

7. The composition of claim 2, further comprising (f) an adhesion-preventing agent.

8. The composition of claim 2, further comprising (g) third particles comprising another refractory stain, wherein the another refractory stain comprises metal oxides that are fired for color stability and ground into a fine powder having an average particle diameter of at most 50 mesh prior to incorporation into said composition.

9. The composition of claim 2, wherein said first particles have an average particle diameter of at most 1000 $\mu$m, and said second particles have an average particle diameter of at most 300 $\mu$m.

10. The composition of claim 4, further comprising a solvent, and wherein said refractory metal oxide is stable in air at a temperature of at least 1976° F.

11. The composition of claim 10, wherein said solvent is water, and said binder is a cellulose binder.

12. A sintered metal object, comprising:

(a) a jewelry-metal, and (b) second particles comprising a refractory stain, in said jewelry-metal, wherein said refractory stain provides color to said jewelry-metal and comprises metal oxides that are fired for color stability and ground into a fine powder having an average particle diameter of at most 50 mesh.

13. The sintered metal object of claim 12, wherein said second particles are in a subsurface of said metal object.

14. The sintered metal object of claim 13, wherein said second particles are present throughout said metal object.

15. The sintered metal object of claim 12, wherein said jewelry-metal is selected from the group consisting of silver, gold, and platinum.

16. The sintered metal object of claim 15, wherein said jewelry-metal comprises at least one metal selected from the group consisting of fine silver, sterling silver, 24 karat gold, 18 karat gold, 14 karat gold, and 10 karat gold.

17. The sintered metal object of claim 12, further comprising (g) third particles comprising another refractory stain, wherein said refractory stain comprises metal oxides that are fired for color stability and ground into a fine powder having an average particle diameter of at most 50 mesh.

18. The sintered metal object of claim 12, wherein said second particles have an average particle diameter of at most 300 $\mu$m.

19. The sintered metal object of claim 12, wherein said refractory metal oxide is stable in air at a temperature of at least 1976° F.

20. The sintered metal object of claim 12, wherein said jewelry-metal and said refractory stain are not an alloy.

21. The sintered metal object of claim 12, wherein said sintered metal object is shaped with hand tools, machine, or die.

22. The sintered metal object of claim 12, wherein said sintered metal object is hammered or drawn into a wire.

* * * * *

UNITED STATES PATENT AND TRADEMARK OFFICE

CERTIFICATE OF CORRECTION

PATENT NO. : 6,572,670 B1
DATED : June 3, 2003
INVENTOR(S) : Billie Jean Theide et al.

It is certified that error appears in the above-identified patent and that said Letters Patent is hereby corrected as shown below:

Title page,
Item [56], References Cited, OTHER PUBLICATIONS, "Masons" reference, delete "com au/" and substitute -- com.au/ -- in its place; and delete "w pages" and substitute -- 2 pages -- in its place.

Signed and Sealed this

Twenty-fifth Day of May, 2004

JON W. DUDAS
*Acting Director of the United States Patent and Trademark Office*